US005450189A

United States Patent [19]

Russell et al.

[11] Patent Number: 5,450,189

[45] Date of Patent: Sep. 12, 1995

[54] ELECTROPHOTOGRAPHIC IMAGING WITH TONERS OF OPPOSITE SIGN ELECTRICAL CHARGE

[75] Inventors: Dale D. Russell; James G. Bearss, both of Boise, Id.

[73] Assignee: Hewlett-Packard Company, Palo Alto, Calif.

[21] Appl. No.: 196,937

[22] Filed: Feb. 15, 1994

[51] Int. Cl.[6] ..... G03G 15/01

[52] U.S. Cl. ..... 355/326; 355/245; 430/35; 430/44

[58] Field of Search ..... 355/326, 327, 245; 430/42, 35, 44

[56] References Cited

U.S. PATENT DOCUMENTS

| | | | |
|---|---|---|---|
| 5,155,541 | 10/1992 | Loce et al. | 355/326 X |
| 5,194,351 | 3/1993 | Roller | 430/45 |
| 5,241,358 | 8/1993 | Germain et al. | 355/326 |
| 5,241,359 | 8/1993 | Williams | 355/326 |

*Primary Examiner*—R. L. Moses

[57] ABSTRACT

A system and method for electrophotographic printing an image with a plurality of toners, where the plurality of toners includes toners that are attracted to either a first charge potential or a second charge potential. The electrophotographic system includes a photoconductive surface that is charged to the second charge potential. A laser selectively discharges the photoconductive surface to the first charge potential in accordance the image to be printed. Those toners that are attracted to the first charge potential are applied to the photoconductive surface, wherein the toners are electrostatically attracted to those areas of the photoconductive surface that are at the first charge potential. The photoconductive surface again charged to the second charge potential. The photoconductive surface is again discharged to the first charge potential in accordance with those areas of the image to which those toners that are attracted to the second charge potential are to be repelled. Those toners that are attracted to the second charge potential are applied to the photoconductive surface, wherein the toners are electrostatically attracted to those areas of the photoconductive surface that remain at the first charge potential. Finally, the image is transferred to a receiving surface.

12 Claims, 5 Drawing Sheets

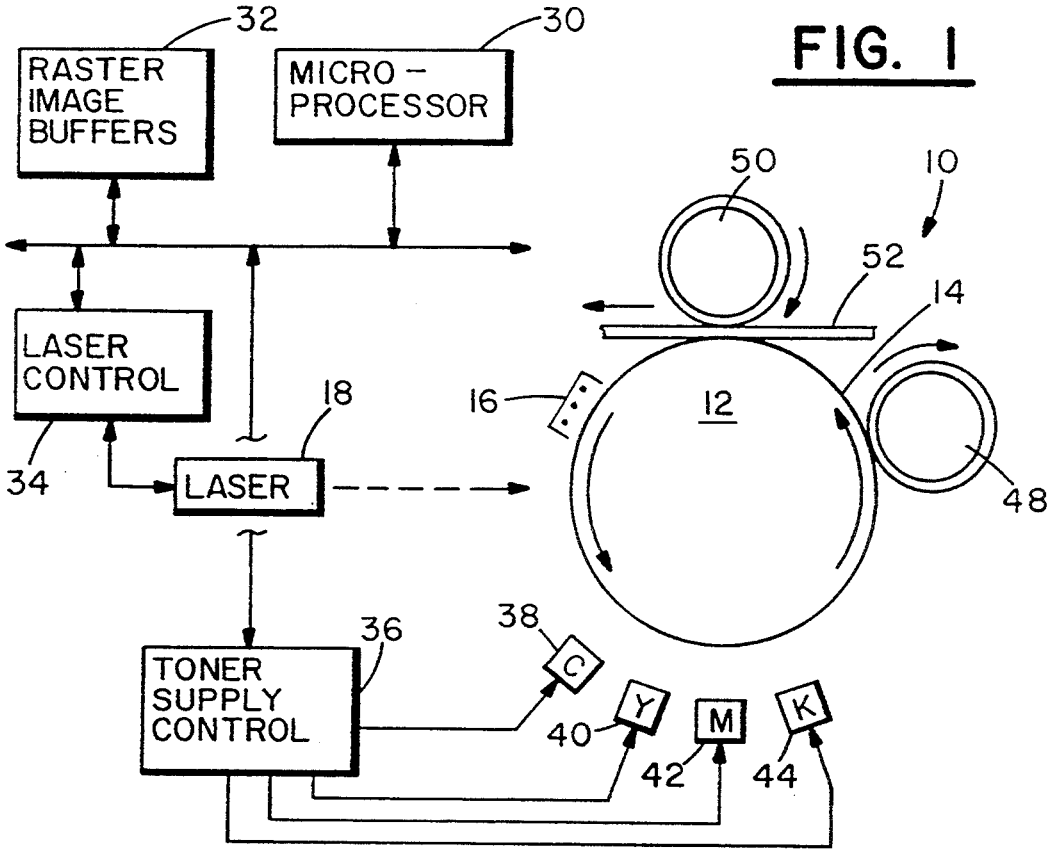
FIG. 1
FIG. 2
(D.A.D.)
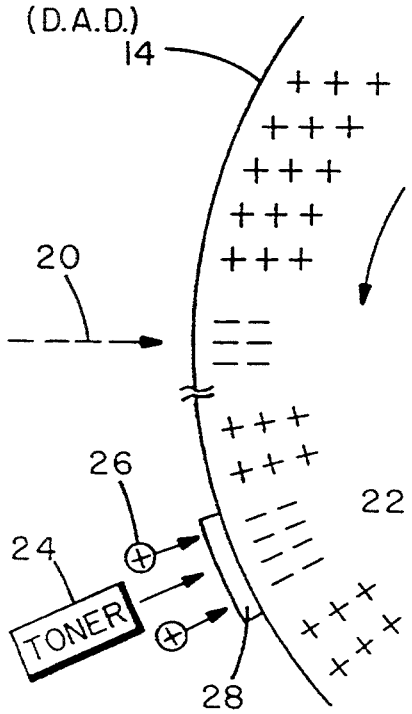
FIG. 3
(C.A.D.)
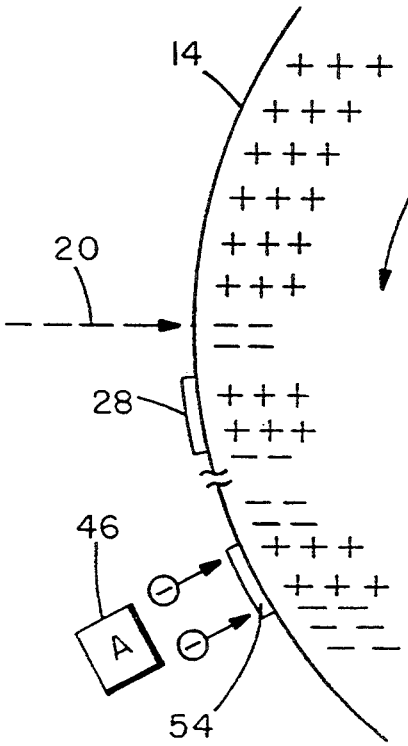

ELECTROPHOTOGRAPHIC IMAGING WITH TONERS OF OPPOSITE SIGN ELECTRICAL CHARGE

RELATED APPLICATIONS

The present invention relates generally to the following U.S. patent application being assigned to the same assignee, entitled:

"METHOD AND APPARATUS FOR APPLYING AN ADHESIVE LAYER FOR IMPROVED IMAGE TRANSFER IN ELECTROPHOTOGRAPHY," Ser. No. 08/097,815 filed on Jul. 26, 1993.

FIELD OF THE INVENTION

The present invention relates generally to electrophotographic imaging system, more particularly, to the elimination of the restriction that all toners be capable of charging to the same sign of electrical charge.

BACKGROUND OF THE INVENTION

As is known in the art of electrophotographic imaging, a photoconductive surface in an electrophotographic imaging system is first charged to a uniform potential and then is "exposed" to an image to be reproduced by the scanning of a laser beam thereacross. The photoconductor thereby obtains an electrostatic latent image that constitutes a matrix of discharged pixels on the photoconductor's surface. In a black and white printer, the photoconductive surface is generally developed using a black toner that adheres to the discharged pixel areas to form the image. Thereafter, the toned photoconductive surface is then carried to a transfer station where the image is transferred to a media sheet.

In a multi-color printer, successive images are developed employing different color toners supplied from corresponding toner modules. Color printing is normally done with yellow, cyan and magenta toners that are applied, in registration, during successive rotations of the photoconductive surface. The printer also generally includes a toner module with black toner. The developed color image is then transferred from the photoconductive surface to a media sheet. As is understood in the art, an alternative method to that described above is to use an intermediate medium wherein the individual color planes are transferred from the photoconductive surface to the intermediate medium. Once all the color planes have been transferred to the intermediate media, the composite image is transferred to the final media sheet. Heat is usually applied to permanently fuse the image to the media sheet in order to form a completed multi-color print.

The electrophotographic process is based on the electrostatic attraction of charged toner particles for opposite (or relatively opposite) sign charge on a photoconductor material on which an image has been formed. The surface of the photoconductor may be positive relative to the negative charge on the toner particles, or vice versa.

In most electrophotography, the desired image is developed on the photoconductor (often an organic photoconductor, OPC) using the customary principles of discharge area development (DAD). For DAD, the OPC must be capable of charging to the same sign of electrical potential as the formal charge on the toner. For example, when the OPC charges positively, the toner must have a positive charge. The concept also works when the OPC and toner are both negatively charged. DAD is preferred because the printed dots are oval or elliptical, which gives better print quality in terms of edge smoothness of the printed images.

In DAD printing, the entire surface of the OPC is charged up to a certain potential, the laser discharges those areas to be imaged ("write black"), and toner particles, having the same sign charge as the still-charged area of the OPC, are brought into contact with the OPC. The toner particles are electrostatically repelled by the same-sign charged areas and attracted to the discharged image area. Thus, the toner is electrostatically deposited onto the OPC. If the toners are transparent enough to the laser light, this process can be repeated until as many color planes as desired are overlaid.

Alternatively, a toner may be used which has an opposite sign charge to the photoconductor material and results in charge area development (CAD). Using a CAD process, the laser must discharge the area that is NOT intended to receive the toner (write white). The toner, which is of opposite sign compared to charged imaged areas, is electrostatically repelled by the discharged area and attracted to the opposite-sign charged areas. This mode is less favored because the dots formed by the toner are the "inverse" of the laser image and consequently have points or cupped edges. Thus, image edges formed by these pointed spots will be rougher and print quality is negatively impacted.

There are many interrelated reasons for choosing a given photoconductor or a given colorant material for the electrophotographic (EP) process, and occasionally the combination of these considerations forces a compromise in the materials set which is not ideal. Considerations regarding the photoconductor, such as production cost, environmental regulations, dark decay characteristics, durability, and the like, impact on the material of the photoconductor, the method of printing that will be used and the sign of electrical charge that must be associated with the toner. In a single-color monochrome printer or copier, this is usually not a major issue.

With multi-colored systems, it is advantageous if all the colored toners are of the same sign, thereby allowing the same imaging technique to be used for all color planes in the process. However, colors are developed using pigments that can have very different molecules each with unique chemistries. These unique chemistries may have considerable impact on the interaction of the pigment with the stabilizing and fusing resins, dispersing media, charging agents and other additives used in the toner formulation. A pigment considered ideal for color and print quality may be rejected because its chemistry renders it incapable of interacting satisfactorily with other components of the toner formulation. A serious situation arises when the pigment cannot satisfactorily accept the charging agent, or when the pigment itself charges to the sign opposite of the other pigments chosen. Therefore, requiring all members of the toner set to have the same sign charge can stand in conflict with other considerations. Such conflicts can result in compromises in color, print quality, toner stability, or the like.

Therefore it is the objective of the present invention to allow toners in a multi-color set to have either sign charge on them, thereby permitting choice of photoconductor regardless of the sign of the electrical charge developed on the photoconductor.

SUMMARY OF THE INVENTION

In order to accomplish the objective of the present invention there is provided an imaging system incorporating the invention that includes a movable photoconductive surface, and an electrostatic system for repetitively charging the photoconductive surface to a first charge potential. Selective areas of the photoconductive surface are discharged to a second charge potential in accordance with image signals. A first toner exhibiting a charge state that is attracted by the second charge potential and is repelled by the first charge potential. There is also a second toner exhibiting an opposite charge state to the first toner. The second toner is attracted by the first charge potential and is repelled by the second charge potential. A controller causes the first toner to be applied to the imaged photoconductive surface and the entire photoconductive surface is recharged. Thereafter, non-imaged areas of the photoconductive surface are discharged to a charge potential that repels the second toner. The second toner is applied to imaged areas that remain at the first charge potential.

BRIEF DESCRIPTION OF THE DRAWINGS

FIG. 1 is a schematic diagram of an electrophotographic imaging system.

FIG. 2 is a partial view of the system of FIG. 1 that illustrates normal toning of a photoconductive surface using a discharge area development method.

FIG. 3 is a partial view of the electrophotographic surface of FIG. 1 that illustrates normal toning of a photoconductive surface using a charge area development method.

DETAILED DESCRIPTION OF THE INVENTION

Figure 4A:
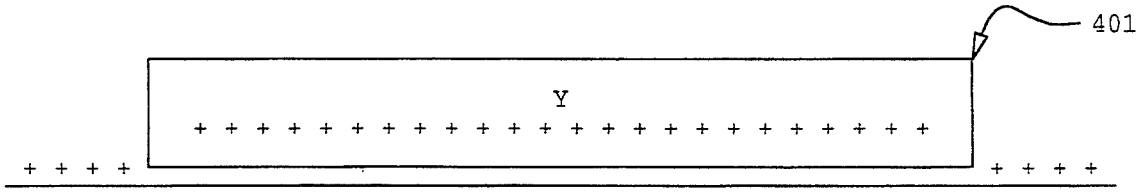
FIGS. 4A, 4B, 4C, 4D, 4E are an exploded view that illustrates normal toning of a photoconductive surface using a discharge area development method for a multicolor imaging system.

Turning to FIG. 1, a color electrophotography system 10 comprises a drum 12 that is coated, in the known manner, with a photoconductive surface 14. While a drum 12 is shown, those skilled in the art will realize that any continuous photoconductive surface 14 may be employed with this invention. An electrostatic charging station 16 charges photoconductive surface 14 as it passes therebeneath. A laser 18 subsequently exposes selected areas of precharged photoconductive surface 14 to create image areas that exhibit a different charge level.

Using the customary principles of discharge area development (DAD), photoconductive surface 14 must be capable of charging to the same sign of electrical potential as charges on a toner to be subsequently used for development. For example, when photoconductive surface 14 is charged by electrostatic charging station 16 to a positive potential, the color toner must also have a positive charge. The invention may also be implemented when photoconductive surface 14 is precharged to a negative potential and the toner is negatively charged.

Using the DAD process, laser 18 discharges selected areas on photoconductive surface 14. Thus, assuming that electrostatic charging station 16 causes photoconductive surface 14 to have a high positive potential, laser 18 acts to discharge photoconductive surface 14 to a more negative potential. It is to be understood that the potential values to be hereafter described are relative to each other and not with respect to any absolute value or measure.

In FIG. 2, photoconductive surface 14 is shown after having been charged to a high positive potential by electrostatic charging station 16. Beam 20 from laser 18 reduces (i.e., "discharges") the charge potential on electrostatic surface 14 to a more negative level in accordance with applied image signals. When a discharged area 22 reaches the vicinity of a toner supply 24, controlling signals are applied which enable release of positively charged toner particles 26 that adhere to discharged area 22 to produce a developed spot 28.

The CAD process is shown in FIG. 3. Here, photoconductor surface 14 is initially charged by electrostatic charging station 16 to a high positive value. Laser beam 20 is controlled to discharge non-image areas of photoconductive surface 14 as it passes therebeneath. Areas of photoconductive surface 14 that are not exposed to the laser retain their high positive charge. The adjoining areas of photoconductive surface 14 exhibit a relatively negative potential and, as a result, exert a repulsive action that prevents the negatively charged toner particles from depositing thereon.

Returning to FIG. 1, electrophotographic system 10 is controlled by a microprocessor 30 which, in combination with image information in raster image buffer 32, feeds image data to laser 18 through laser control circuit 34. Microprocessor 30 also issues signals to operate toner supply control module 36 which in turn generates signals to control cyan, yellow, magenta, and black toner supplies 38, 40, 42, and 44, respectively. A toner conditioning roller 48 both compresses and heats toner applied to photoconductive surface 14. A transfer roller 50 provides both heat and pressure to a media sheet 52 thereby enabling toner transfer to occur from photoconductive surface 14 to media sheet 52.

In performing a color printing action, raster image buffers 22 contain at least three color planes, e.g., cyan, yellow and magenta. In synchronism with the rotation of drum 12, a color plane is read out and controls laser 18 to cause the particular color plane image to be produced on photoconductive surface 14. Toner supply control 36 then causes the appropriate toner module (e.g., cyan module 38), to operate and to develop the exposed cyan image on photoconductive surface 14. That image is then conditioned by roller 48 and proceeds around drum 12, past electrostatic charging station 16 where photoconductive surface 14 is again charged. A second color plane from raster image buffers 32 is then read out and controls laser 18 to discharge areas of photoconductive surface 14 that are to be developed using a second color toner. (At this point, it is to be noted that there is no media sheet present in contact with drum 12 and such contact will not occur until all color planes have been read out to control laser 18 to produce registered images.) The exposure/development actions proceed through the cyan, yellow, magenta and black toner stations, in sequence, until photoconductive surface 14 has been toned in accordance with the image information contained in all raster image buffers 32.

The desired image is developed on the OPC with the toners that can charge to the same sign as the photoconductor, using the customary principles of discharge area development (DAD). When it is time to develop the opposite charging toners, the print mode is changed to the CAD method. The OPC is charged and the laser discharges all NON-imaged areas. The background area, rather than the imaged area is now discharged, a process called "writing white." The opposite sign toner layer develops in all areas remaining charged.

To aid the reader's understanding of the present invention, a simple example showing both the DAD method and the present invention follows.

Referring first to FIG. 4A, the Organic Photoconductor (OPC) is first charged, in this case to a positive charge. Next, the laser writes black by selectively discharging those areas to which toner is to be applied. In FIG. 4A the color yellow 401 is added as a base layer. Yellow 401 having a positive charge is electrostatically attracted to the organic photoconductor in the areas the laser has discharged.

Figure 4B:
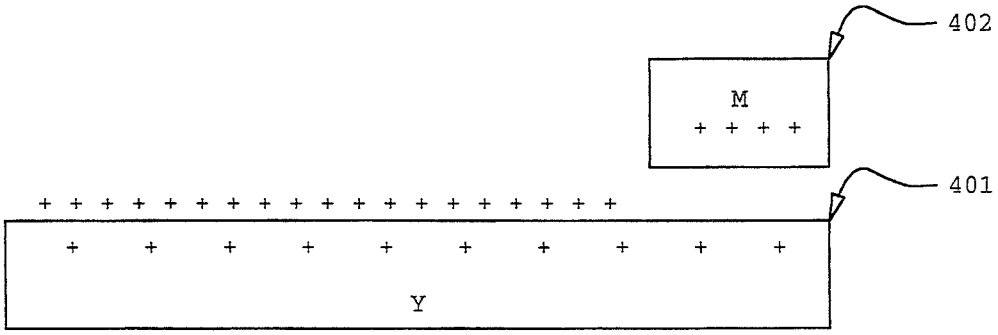
Figure 4C:
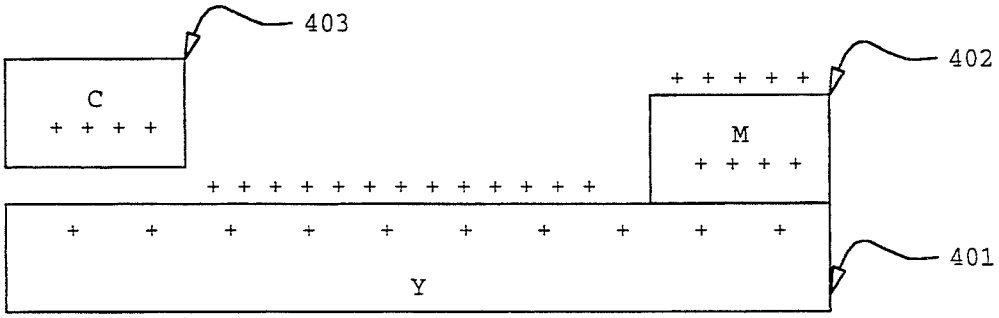
Figure 4D:
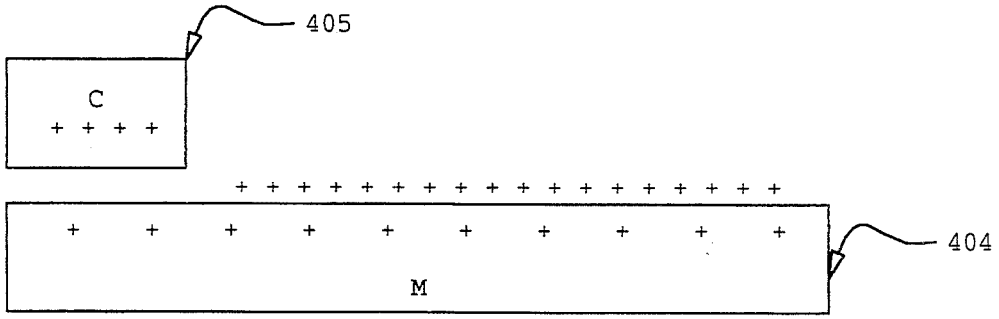
Figure 4E:
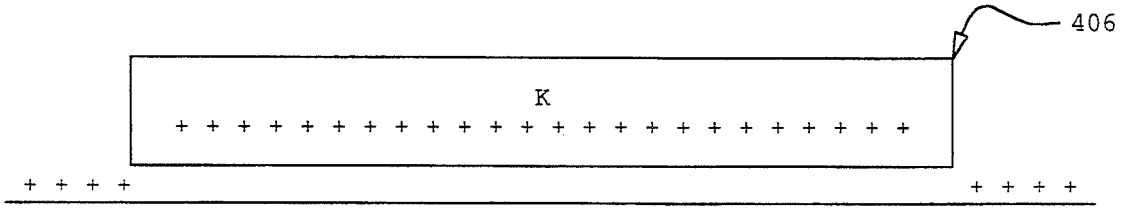

In FIG. 4B, magenta 402 is added to the underlying yellow coat 401 to create the color red. Because yellow 401 has been charged by the charging device to a positive charge, those areas where the magenta 402 is to be attached are selectively discharged. Here, magenta 402 having a positive charge is attracted to the relatively less positive charged areas of yellow 401. In FIG. 4C, cyan 403 is to be added to the underlying yellow 401 to create the color green. Both the yellow 401 and the additional magenta 402 must first be charged positively. Areas to which the green is to be printed are then selectively discharged by the laser. Cyan 403 with its positive charge is again electrostatically attracted to the relatively negative charged areas. FIG. 4D shows a similar arrangement wherein cyan 405 is being deposited on an underlying coat of magenta 404 to create blue. Finally, in FIG. 4E, a layer of the black toner 406 is deposited on the organic photoconductor.

Reviewing FIG. 4, the DAD process was used throughout. First, the underlying structure was charged positively. Next, selective areas were discharged wherein the toner to be applied was electrostatically attracted to those discharged areas.

FIG. 5 shows how, by using a mix of CAD and DAD processes, toners of either positive or negative electrostatic charges can be used. In FIG. 5A, a positively charged yellow toner 501 is applied using the DAD process to the organic photoconductor. As has been described earlier, the photoconductor is first charged positively and then selectively discharged in those areas to which the toner is to be applied. Once the organic photoconductor has been discharged it is brought into contact with the positively charged yellow toner 501.

Figure 5A:
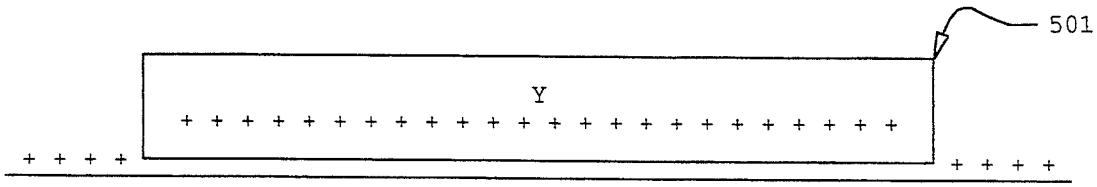
FIGS. 5A, 5B, 5C, 5D, 5E are an exploded view of the electrophotographic surface showing normal toning of a photoconductive surface using a charge area development method for a multi-color imaging system.
Figure 5B:
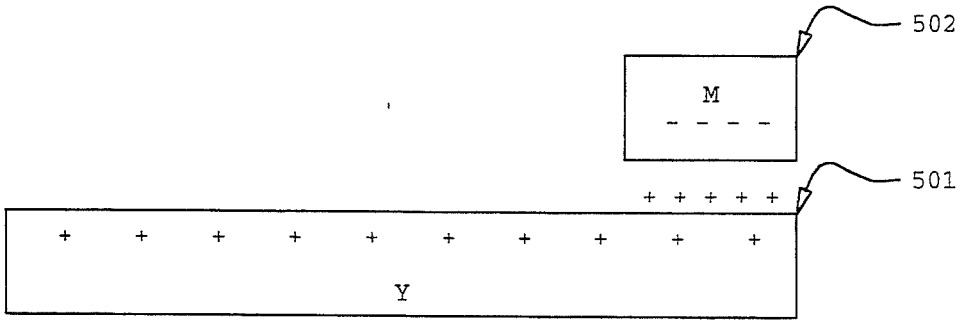

Next, in FIG. 5B a negatively charged toner magenta 502 is applied to the positively charged yellow 501 to create the color red. Again, the toner 501 is charged to a relatively positively level. Those areas to which the magenta toner 502 is not to be applied are discharged. Thus, toner yellow 501 has areas of relatively positive charge to which magenta toner 502 is electrostatically attracted.

Figure 5C:
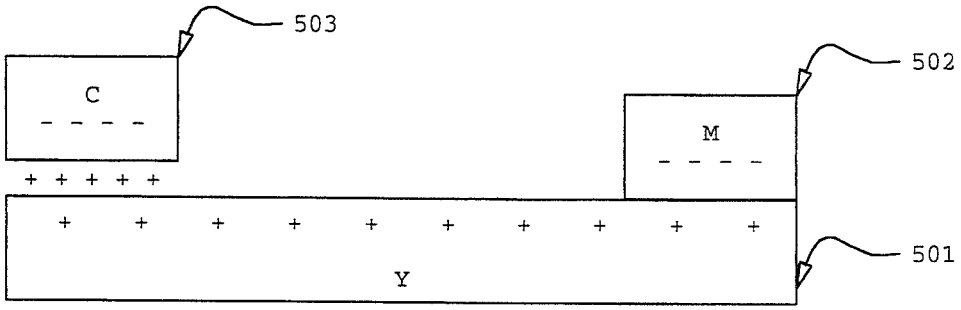
Figure 5D:
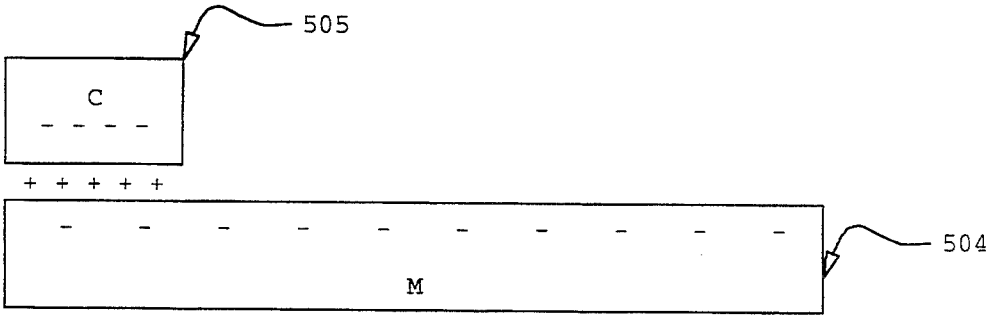
Figure 5E:
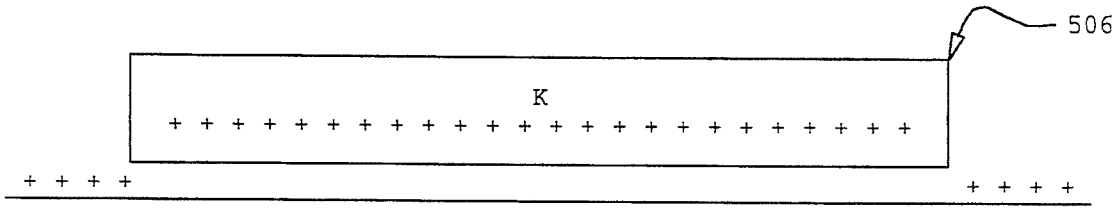

In a similar manner, FIG. 5C shows green being created using the CAD method. Looking at FIG. 5D, the CAD method is used again to combine cyan 505 with magenta 504 to create the color blue. Here, the underlying magenta 504 has a relatively negative charge as well as the cyan 505. Again, the underlying color magenta 504 is first charged to a positive charge. Next, using the CAD method those areas to which the cyan is not to be added are discharged leaving select areas of the magenta 504 with relatively positive charges. This is then brought into contact with the cyan toner. The cyan toner 505 is electrostatically attracted to those areas of the magenta 504 that still exhibit the relatively positive charge. Finally, in FIG. 5E the color black 506 is added using the DAD process as described earlier.

Thus summarizing FIG. 5, toners can be added using either the DAD or CAD process thereby alleviating the requirement that all toners exhibit the same electrostatic properties. By removing this requirement the constraints on the selection of toner, while not completely removed, are at least reduced in number.

As understood by one skilled in the art, an alternative embodiment to the above allows for the majority of the toners charge to the opposite sign of the photoconductor, and the minority of the toners develop the same sign as the photo-conductor. With this embodiment the charge area development method is used for the toners with sign opposite the photoconductor and DAD is used for the others. This embodiment is less preferred because the printed dots are cupped and are more prone to jagged edges on the image. One skilled in the art would also understand that an alternative method to that described above is to use an intermediate medium wherein the individual color planes are transferred from the photoconductive surface to the intermediate medium.

In conclusion, with the present invention, toner selection may be based on criteria other than their capability to charge to a particular sign. This allows selection from a far greater group of candidate pigments. Both negatively and positively charged toner particles may be used in the same printer.

Although the preferred embodiment of the invention has been illustrated, and that form described, it is readily apparent to those skilled in the art that various modifications may be made therein without departing from the spirit of the invention or from the scope of the appended claims.

What is claimed is:

1. An electrophotographic imaging system comprising:

a photoconductive surface;

an electrostatic means for repetitively charging said photoconductive surface to a first charge potential;

a discharger means for selectively discharging said photoconductive surface to a second charge potential in accordance with applied image signals;

a first toner supply means for providing a first toner to said photoconductive surface, said first toner exhibiting a charge state that is attracted by said second charge potential and repelled by said first said charge potential;

a second toner supply means for providing a second toner to said photoconductive surface, said second toner exhibiting an opposite sense charge state to said first toner, said second toner attracted by said first charge potential and repelled by said second charge potential; and control means for causing said discharger means to alter a charge state of an imaged area of said photoconductive surface to said second charge potential and to control said first toner supply to apply said first toner to said photoconductive surface in accordance with a first image produced thereon by action of said discharger means, and for causing said discharger means to alter a charge state of a non-imaged area of said photoconductive surface to said second charge potential and to control said second toner supply means to apply said second toner to said photoconductive surface in accordance with a second image produced thereon by action of said discharger means.

2. An electrophotographic imaging system as claimed in claim 1, wherein said discharger means is a laser means.

3. A method for electrophotographic printing an image with a plurality of toners, said plurality of toners including a first plurality of toners being attracted to a first charge potential, said plurality of toner further including a second plurality of toners being attracted to a second charge potential, said method comprising the steps of:

charging a photoconductive surface to said second charge potential;

first selectively discharging said photoconductive surface to said first charge potential in accordance with those areas of said image to which a toner from said second plurality of toners is to be repelled;

first applying said toner from said second plurality of toners to said photoconductive surface;

recharging said photoconductive surface to said second charge potential;

second selectively discharging said photoconductive surface to said first charge potential in accordance with those areas of said image to which a toner from said first plurality of toners is to be added; and second applying said toner from said first plurality of toners to said photoconductive surface.

4. The method for electrophotographic printing as claimed in claim 3, wherein said step of first selectively discharging and said step of second selectively discharging is performed by a laser.

5. The method as recited in claim 3 wherein said first plurality of toners are image wise applied to said photoconductive surface by a discharge area development procedure and said second plurality of toners are applied using a charge area development procedure.

6. The method as recited in claim 3 wherein said first toner is image-wise applied to said photoconductive surface by a charge area development procedure and said second toner is applied using a discharge area development procedure.

7. The method as recited in claim 3 further comprising the step of transferring said image to a receiving surface.

8. The method as recited in claim 3 further comprising the steps of:

first repeating said steps of charging, first selectively discharging, and first applying for each toner in said second plurality of toners; and second repeating said steps of recharging, second selectively discharging, and second applying for each toner in said first plurality of toners.

9. A method for electrophotographic printing an image with a plurality of toners, said plurality of toners being divided into a first group of toners being attracted to a first charge potential and a second group of toners being attracted to a second charge potential, said method comprising the steps of:

charging a photoconductive surface to said second charge potential;

first selectively discharging said photoconductive surface to said first charge potential in accordance with those areas of said image to which a toner from said second group of toners is to be repelled;

first applying said toner from said second group of toners to said photoconductive surface;

recharging said photoconductive surface to said second charge potential;

second selectively discharging said photoconductive surface to said first charge potential in accordance with those areas of said image to which a toner from said first group of toners is to be added;

second applying said toner from said first group of toners to said photoconductive surface;

first repeating said steps of charging, first selectively discharging, and first applying for each toner in said second group; and second repeating said steps of recharging, second selectively discharging, and second applying for each toner in said first group.

10. The method as recited in claim 9, wherein said step first selectively discharging and said step of second selectively discharging is performed by a laser.

11. The method as recited in claim 9 wherein said first group of toners are image wise applied to said photoconductive surface by a discharge area development procedure and said second group of toners are applied using a charge area development procedure.

12. The method as recited in claim 9 further comprising the step of transferring said image to a receiving surface.

* * * * *